US011328703B2

(12) United States Patent
Mizushina

(10) Patent No.: US 11,328,703 B2
(45) Date of Patent: May 10, 2022

(54) LOUDSPEAKER DEVICE, ACOUSTIC CONTROL METHOD, AND NON-TRANSITORY RECORDING MEDIUM

(71) Applicant: CASIO COMPUTER CO., LTD., Tokyo (JP)

(72) Inventor: Takahiro Mizushina, Kawagoe (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/030,164

(22) Filed: Sep. 23, 2020

(65) Prior Publication Data

US 2021/0090546 A1 Mar. 25, 2021

(30) Foreign Application Priority Data

Sep. 24, 2019 (JP) ..... JP2019-172924

(51) Int. Cl.
*G10K 11/178* (2006.01)
*H04R 1/02* (2006.01)

(52) U.S. Cl.
CPC .. *G10K 11/17854* (2018.01); *G10K 11/17881* (2018.01); *H04R 1/025* (2013.01); *G10K 2210/3026* (2013.01); *G10K 2210/3027* (2013.01); *G10K 2210/3028* (2013.01); *G10K 2210/3221* (2013.01); *G10K 2210/3224* (2013.01)

(58) Field of Classification Search
CPC .. H04R 5/0335; H04R 5/023; H04R 2499/13; H04R 1/025; H04R 1/1083; G10K 11/17857; G10K 2210/3221; G10K 11/17881; G10K 11/17854; G10K 11/178
See application file for complete search history.

(56) References Cited

U.S. PATENT DOCUMENTS 5,278,780 A * 1/1994 Eguchi ..... G10K 11/17819 708/322
2018/0084326 A1* 3/2018 Rothschild ..... H04R 1/1008
2018/0316995 A1* 11/2018 Miyoshi ..... G10K 9/122
2020/0105242 A1* 4/2020 Griffin ..... G10K 11/17854

FOREIGN PATENT DOCUMENTS

JP H11-298275 A 10/1999
JP 2012-255852 A 12/2012
JP 2017-521730 A 8/2017
JP 2018-121256 A 8/2018
JP 2019-129538 A 8/2019

* cited by examiner

*Primary Examiner* — Kile O Blair
(74) *Attorney, Agent, or Firm* — Fitch, Even, Tabin & Flannery LLP

(57) ABSTRACT

A loudspeaker device includes at least one loudspeaker, a loudspeaker holder holding the at least one loudspeaker in a reference range away from the ear of a user by a reference distance, a first microphone collecting an environmental sound and outputting an electrical signal, a second microphone attached to a position where a sound output from the at least one loudspeaker is collected, the second microphone collecting a synthetic sound synthesized from the sound output from the at least one loudspeaker and the environmental sound and outputting an electrical signal, and a processor controlling the at least one loudspeaker so as to output a sound for reducing the environmental sound based on the electrical signals representing the sounds collected by the first microphone and the second microphone.

11 Claims, 12 Drawing Sheets

LOUDSPEAKER DEVICE, ACOUSTIC CONTROL METHOD, AND NON-TRANSITORY RECORDING MEDIUM

CROSS-REFERENCE TO RELATED APPLICATION

This application claims the benefit of Japanese Patent Application No. 2019-172924, filed on Sep. 24, 2019, the entire disclosure of which is incorporated by reference herein.

FIELD

This application relates to a loudspeaker device, an acoustic control method, and a non-transitory recording medium.

BACKGROUND

A user uses headphones, earphones, or the like when listening to music or the like alone. Headphones and earphones, which are worn so as to close the ears of the user, have therefore a sound proofing effect and can shut out environmental sounds including noise, such as loud sounds. Particularly, headphones or earphones with an active noise cancelling function collect an environmental sound through a microphone, and then add a sound wave having an opposite phase to a reproduced sound, thereby enabling attenuation of the environmental sound heard transmitting through the headphones or the earphones.

However, headphones are pressed against the auricles and peripheral portions thereof, which exert unpleasant feeling of pressure upon the ears of the user. Additionally, earphones are pushed into the ear canals, similarly exerting an unpleasant feeling of pressure. Wearing headphones or earphones for long hours can cause pain. Thus, to prevent an unpleasant feeling of pressure or pain on the ears of a user, neck hanging loudspeaker devices that are worn around a neck portion and shoulder portions of the user have been commercialized. For example, Unexamined Japanese Patent Application Publication No. 2018-121256 discloses a neck hanging loudspeaker device including a housing curved in a substantially inverted U-shape so as to be engageable around the neck and the shoulders of a user and loudspeakers attached to the housing.

In the neck hanging loudspeaker device disclosed in Unexamined Japanese Patent Application Publication No. 2018-121256, ambient environmental sounds are heard unattenuated. Therefore, turning up the volume so that sounds output from the loudspeakers are not drown out by the ambient environmental sounds leads to sound leakage, which may annoy others around the user.

SUMMARY

A loudspeaker device according to a preferable aspect of the present disclosure includes at least one loudspeaker, a loudspeaker holder holding the at least one loudspeaker in a reference range away from an ear of a user by a reference distance, a first microphone collecting an environmental sound and outputting an electrical signal, a second microphone attached to a position where a sound output from the at least one loudspeaker is collected, the second microphone collecting a synthetic sound synthesized from the sound output from the at least one loudspeaker and the environmental sound and outputting an electrical signal, and a processor controlling the at least one loudspeaker so as to output a sound for reducing the environmental sound based on the electrical signals representing the sounds collected by the first microphone and the second microphone.

BRIEF DESCRIPTION OF THE DRAWINGS

A more complete understanding of this application can be obtained when the following detailed description is considered in conjunction with the following drawings, in which.

DETAILED DESCRIPTION

Hereinafter, a loudspeaker device according to an embodiment will be described with reference to the drawings.

Figure 1:
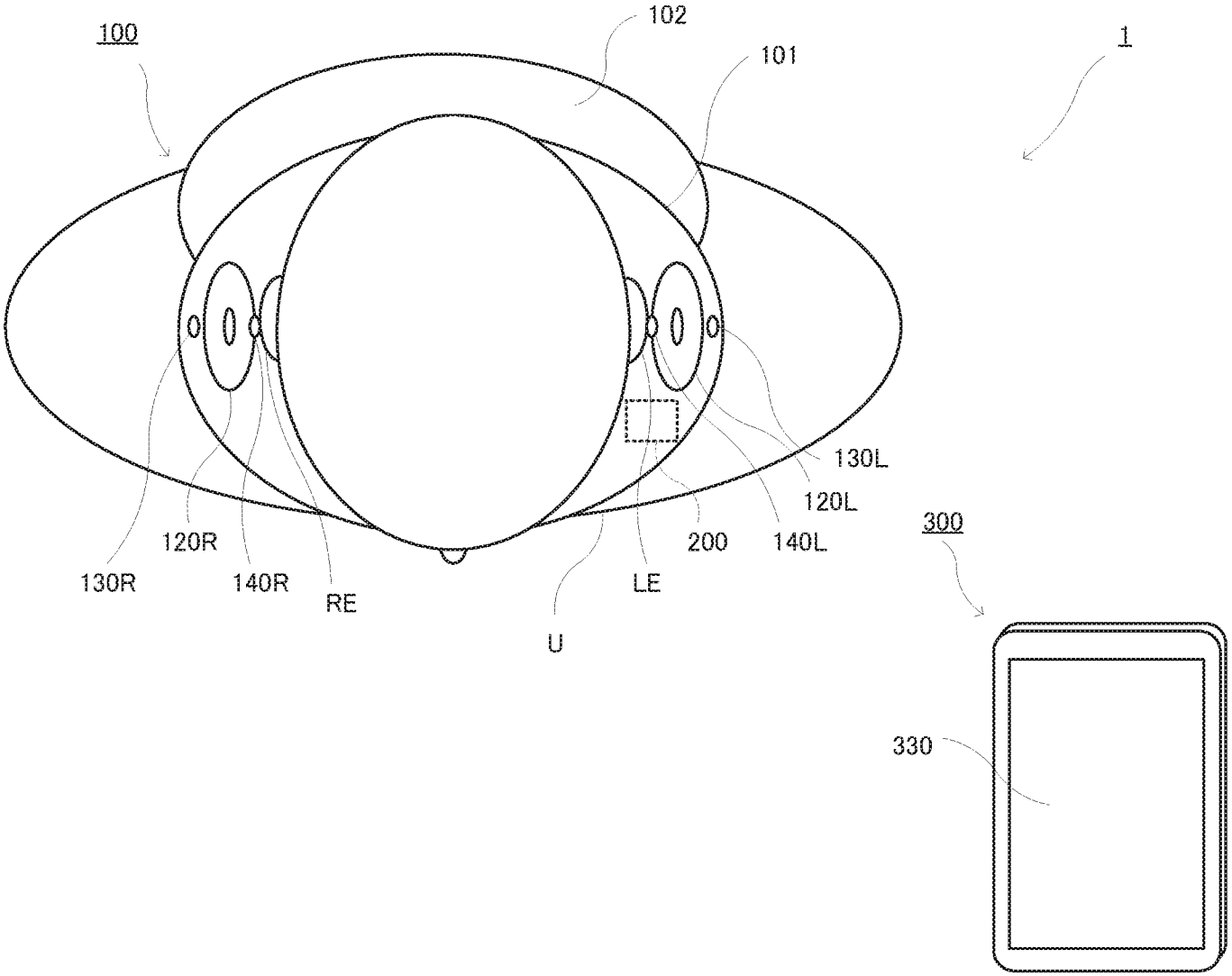
FIG. 1 is a diagram illustrating a loudspeaker device and a terminal device according to an embodiment.

As illustrated in FIG. 1, a loudspeaker device 100 according to the present embodiment is worn around the neck and the shoulders of a user U to allow the user U to listen to sounds such as music. The loudspeaker device 100 converts an audio signal output from a terminal device 300 to a sound, and outputs the sound. The terminal device 300 comprises a smart phone or a tablet personal computer (PC), and transmits an audio signal or the like to the loudspeaker device 100. The loudspeaker device 100 and the terminal device 300 are communicable with each other through a wired network or a wireless network. Note that the loudspeaker device 100 and the terminal device 300 form a loudspeaker system 1. The following will be a description of a structure of the loudspeaker device 100 for reducing an environmental sound that is a sound to be controlled. The environmental sound includes noise such as loud sounds.

The loudspeaker device 100 includes a neckwear 101, a hood 102, a left loudspeaker 120 L, a right loudspeaker 120R, a first left microphone 130L, a first right microphone 130R, a second left microphone 140L, a second right microphone 140R, and an acoustic control unit 200.

Figure 2:
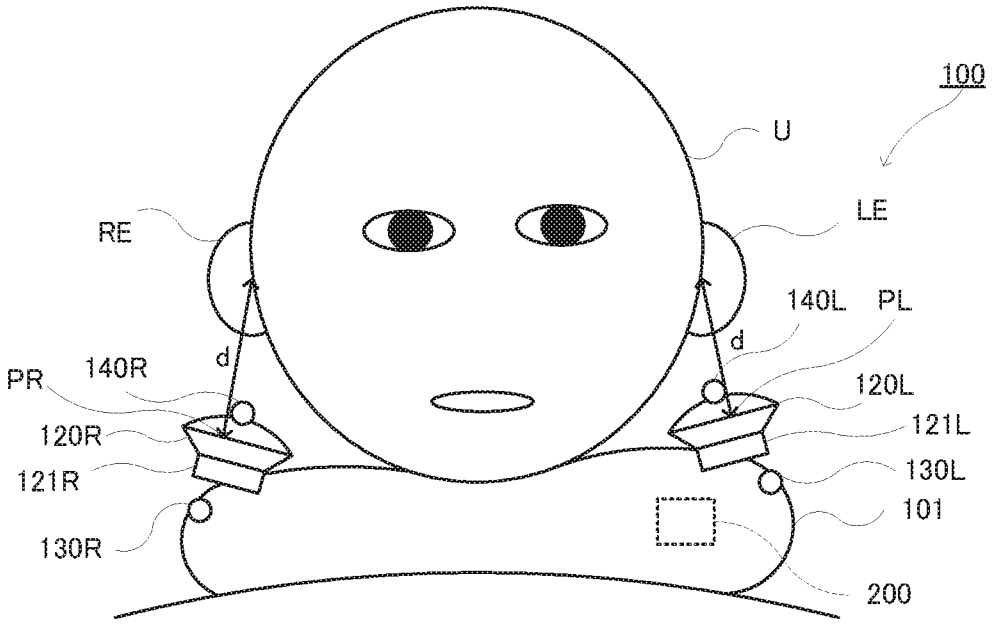
FIG. 2 is a diagram illustrating the loudspeaker device according to the embodiment.

As illustrated in FIG. 2, the neckwear 101 (a loudspeaker holder), which is a portion for fitting the loudspeaker device 100 around the neck and the shoulders of the user U, is formed using a flexible material, such as cloth, and has a ring shape or a U-shape to be wound around the neck. The neckwear 101 is formed in such a shape as to hold the left loudspeaker 120L at an angle where a sound is generated toward a left ear LE of the user U in a reference range away from the left ear LE by a reference distance d. Similarly, the neckwear 101 is formed in such a shape as to hold the right loudspeaker 120R at an angle where a sound is generated toward a right ear RE of the user U in a reference range away from the right ear RE by the reference distance d. When positions away from the left ear LE and the right ear RE, respectively, by the reference distance d are defined as reference points PL and PR, the reference range includes the reference points PL and PR and vicinities thereof. Specifically, the reference range is within a range defined by a length of approximately 1/10 of a shortest wavelength of a sound that is a control sound output from each of the left loudspeaker 120L and the right loudspeaker 120R from the reference points PL and PR. Directions of the left loudspeaker 120L and the right loudspeaker 120R are kept in such a manner as to be adjustable in accordance with the shape of the head of the user U or the like. The neckwear 101 functions as a loudspeaker holder holding the left loudspeaker 120L and the right loudspeaker 120R in the reference range away from the left ear LE and the right ear RE of the user U by the reference distance d.

Figure 3:
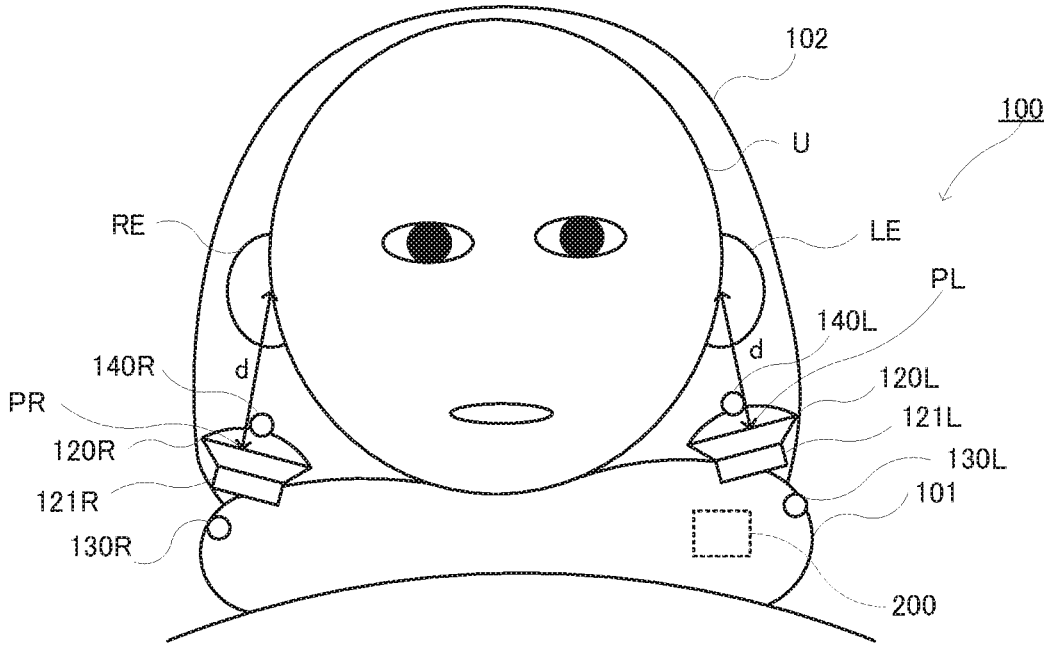
FIG. 3 is a diagram illustrating the loudspeaker device according to the embodiment.

As illustrated in FIG. 3, the hood 102 is attached to a rear portion of the neckwear 101, and is formed by a flexible sound proofing sheet that is shaped to be wearable on the head of the user U and that has at least one of a sound absorbing effect or a sound insulating effect. As a result, the hood 102 covers a back of the head portion and the left and right ears LE and RE of the user U, and can reduce environmental sounds in a high frequency region of approximately 1000 Hz or higher. Additionally, the left loudspeaker 120L, the second left microphone 140L, the right loudspeaker 120R, and the second right microphone 140R are arranged inside the hood 102, whereas the first left microphone 130L and the first right microphone 130R are arranged outside the hood 102. As the sound proofing sheet, specifically, a sound proofing material, such as silicone rubber, glass wool, or urethane sponge is used alone or in a laminate. The hood 102 may be multilayered using cloth or the like on a front surface thereof in consideration of designability. The hood 102 functions as a sound proofing wall that covers the back of the head portion and the left and right ears LE and RE of the user U, the left loudspeaker 120L, the right loudspeaker 120R, the second left microphone 140L, and the second right microphone 140R.

The left loudspeaker 120L and the right loudspeaker 120R convert an audio signal output from the acoustic control unit 200 to a sound that is a control sound, and output the sound. The audio signal output from the acoustic control unit 200 includes an audio signal of the sound that is the control sound for reducing the environmental sound. To prevent a sound having an opposite phase from being output from back surfaces of the left loudspeaker 120L and the right loudspeaker 120R, the back surfaces of the left loudspeaker 120L and the right loudspeaker 120R, respectively, are attached with sound absorbers 121L and 121R for absorbing sounds.

The first left microphone 130L and the first right microphone 130R, which are arranged at positions where an environmental sound is collected, convert the environmental sound to an electrical signal and output the electrical signal to the acoustic control unit 200. The first left microphone 130L is attached to a position where a sound output from the left loudspeaker 120L is not collected, and for example, is attached to the back surface of the left loudspeaker 120L via the sound absorber 121L. Similarly, the first right microphone 130R is attached to a position where a sound output from the right loudspeaker 120R is not collected, and for example, is attached to the back surface of the right loudspeaker 120R via the sound absorber 121R. When using the hood 102, the first left microphone 130L and the first right microphone 130R are arranged outside the hood 102.

The second left microphone 140L, which is attached to a position where a sound output from the left loudspeaker 120L is collected, converts the sound output from the left loudspeaker 120L and an environmental sound to an electrical signal and outputs the electrical signal to the acoustic control unit 200. The second right microphone 140R, which is attached to a position where a sound output from the right loudspeaker 120R is collected, converts the sound output from the right loudspeaker 120R and an environmental sound to an electrical signal and outputs the electrical signal to the acoustic control unit 200. For example, the second left microphone 140L may be attached to a front grill of the left loudspeaker 120L, and the second right microphone 140R may be attached to a front grill of the right loudspeaker 120R. When the loudspeaker device 100 is worn on the user U, the second left microphone 140L is located between the left ear LE of the user U and the left loudspeaker 120L, and the second right microphone 140R is located between the right ear RE of the user U and the right loudspeaker 120R.

Figure 4:
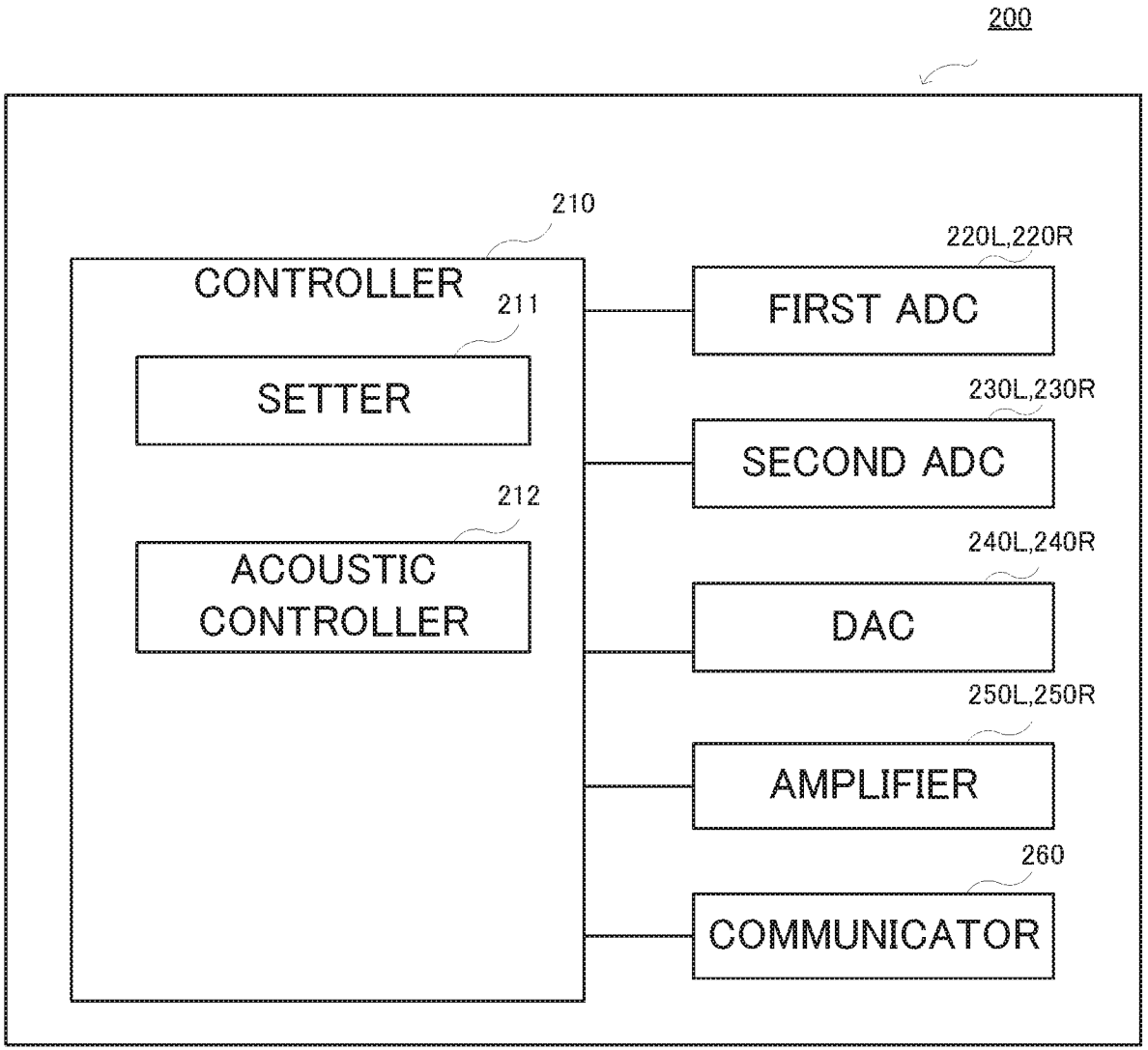
FIG. 4 is a block diagram illustrating the structure of an acoustic control unit according to the embodiment.
Figure 5:
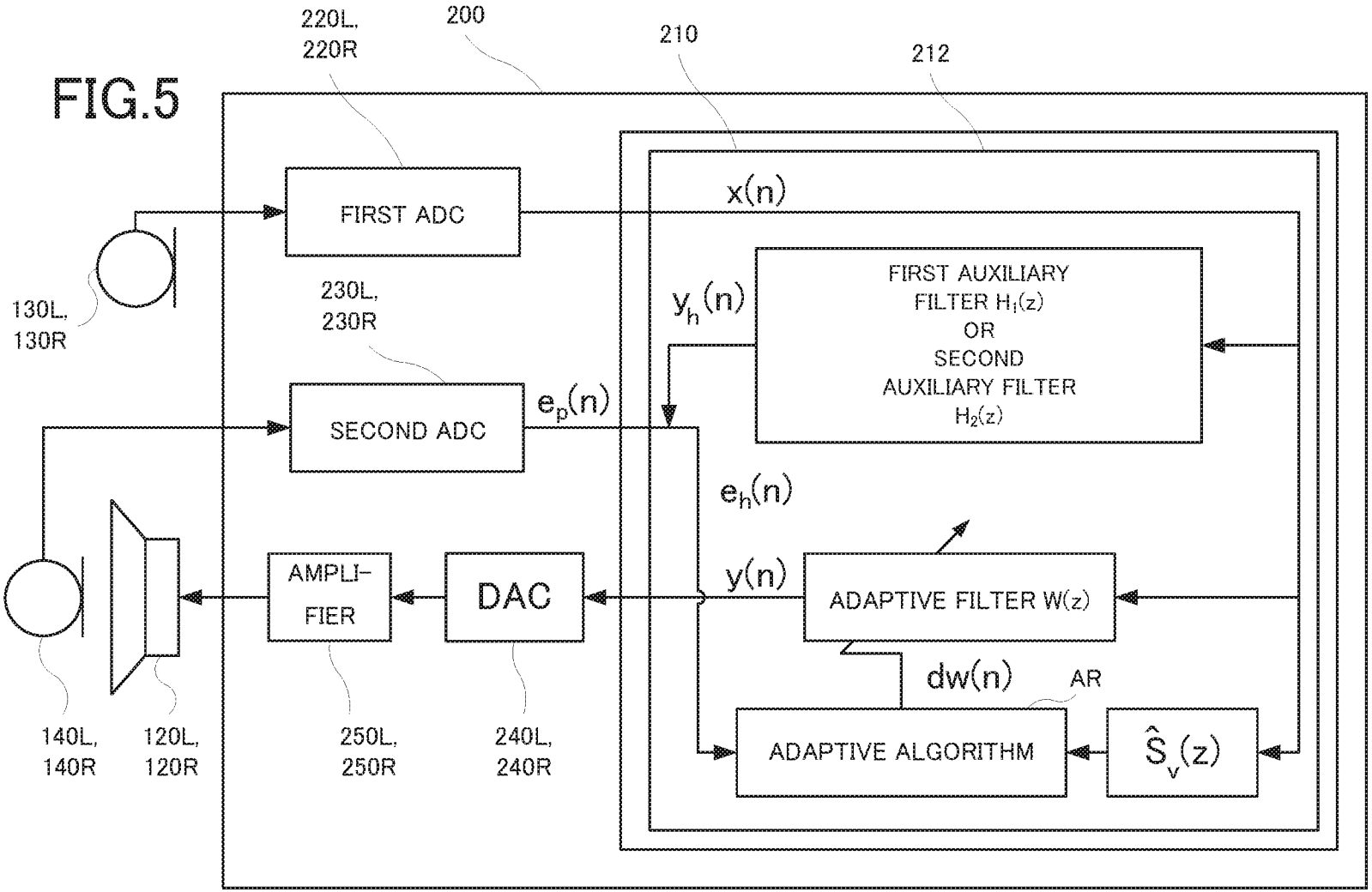
FIG. 5 is a diagram illustrating the algorithm of the acoustic control unit according to the embodiment.

As illustrated in FIGS. 4 and 5, the acoustic control unit 200 includes a processor 210, a left first analog to digital converter (ADC) 220L, a left second ADC 230L, a left digital to analog converter (DAC) 240L, and a left amplifier 250L, a right first ADC 220R, a right second ADC 230R, a right DAC 240R, a right amplifier 250R, and a communicator 260.

The left first ADC 220L converts an analog signal representing a sound collected by the first left microphone 130L to a digital signal, and outputs to the processor 210. The right first ADC 220R converts an analog signal representing a sound collected by the first right microphone 130R to a digital signal, and outputs to the processor 210.

The left second ADC 230L converts an analog signal representing a sound collected by the second left microphone 140L to a digital signal, and outputs to the processor 210. The right second ADC 230R converts an analog signal representing a sound collected by the second right microphone 140R to a digital signal, and outputs to the processor 210.

The left DAC 240L converts a digital signal representing a sound that has been generated by the processor 210 and that is to be output from the left loudspeaker 120L to an analog signal, and outputs to the left amplifier 250L. The right DAC 240R converts a digital signal representing a sound that has been generated by the processor 210 and that is to be output from the right loudspeaker 120R to an analog signal, and outputs to the right amplifier 250R.

The left amplifier 250L amplifies the analog signal output from the left DAC 240L, and outputs to the left loudspeaker 120L. The right amplifier 250R amplifies the analog signal output from the right DAC 240R, and outputs to the right loudspeaker 120R.

The communicator 260 transmits data transmitted from the terminal device 300 indicating whether or not the hood 102 is in use. The communicator 260 comprises a wireless communication module, such as a wireless local area network (LAN) or Bluetooth (registered trademark).

The processor 210 includes a central processing unit (CPU), a digital signal processor (DSP), a read-only memory (ROM), a random-access memory (RAM), and the like. The processor 210 reads out a program stored in the ROM into the RAM and executes the program to function as a setter 211 and an acoustic controller 212.

The setter 211 determines whether or not the hood 102 is in use. When it is determined that the hood 102 is not in use, the setter 211 sets an auxiliary filter that is used by the acoustic controller 212 to a first auxiliary filter $H_1(z)$ having a filter coefficient optimized for a situation where the hood 102 is not used. When it is determined that the hood 102 is in use, the setter 211 sets the auxiliary filter that is used by the acoustic controller 212 to a second auxiliary filter $H_2(z)$ having a filter coefficient optimized for a situation where the hood 102 is used. The first auxiliary filter $H_1(z)$ and the second auxiliary filter $H_2(z)$ convert a digital signal x(n) collected by the first left microphone 130L or the first right microphone 130R to a signal $y_h(n)$ that is a filtered reference signal, as will be described later. The setter 211 determines whether or not the hood 102 is in use based on the data transmitted from the terminal device 300 indicating whether or not the hood 102 is in use. Note that the method for setting the filter coefficients of the first and second auxiliary filters $H_1(z)$ and $H_2(z)$ will be described later.

As illustrated in FIG. 5, the acoustic controller 212 controls each of the left loudspeaker 120L and the right loudspeaker 120R so as to output a sound for reducing an environmental sound based on audio signals representing sounds collected by the first left microphone 130L, the second left microphone 140L, the first right microphone 130R, the second right microphone 140R. Hereinafter, a structure for reducing an environmental sound heard by the left ear LE will be specifically described.

The acoustic controller 212 includes the first and second auxiliary filters $H_1(z)$ and $H_2(z)$, an adaptive filter W(z), and an adaptive algorithm AR. As the first auxiliary filter $H_1(z)$, the second auxiliary filter $H_2(z)$, and the adaptive filter W(z), digital signal processing filters, such as infinite impulse response (IIR) filters or finite impulse response (FIR) filters, are used. As the adaptive algorithm AR, an algorithm, such as recursive least square (RLS), least mean square (LMS), or normalized LMS (NLMS), is used. The adaptive filter W(z) is a filter whose filter coefficient is self-adapted by a correction coefficient dw(n) calculated by the adaptive algorithm AR.

The acoustic controller 212 uses the first auxiliary filter $H_1(z)$ or the second auxiliary filter $H_2(z)$ set by the setter 211 to convert the digital signal x(n) converted by the left first ADC 220L representing a sound at a time point n collected by the first left microphone 130L to the signal $y_h(n)$ that is the filtered reference signal at the time point n. The first auxiliary filter $H_1(z)$ is set to the filter coefficient optimized for the situation where the hood 102 is not used. Additionally, the second auxiliary filter $H_2(z)$ is set to the filter coefficient optimized for the situation where the hood 102 is used.

The adaptive algorithm AR calculates the correction coefficient dw(n) of the adaptive filter W(z) at the time point n based on a signal $e_h(n)$ at the time point n and a signal obtained by converting the digital signal x(n) by using a head-related transfer function (HRTF) $\hat{S}_v(z)$. The signal $e_h(n)$ is obtained by adding the signal $y_h(n)$ obtained by converting the digital signal x(n) representing a sound collected by the first left microphone 130L by using the first auxiliary filter $H_1(z)$ or the second auxiliary filter $H_2(z)$ and a digital signal $e_p(n)$ representing a sound at the time point n collected by the second left microphone 140L.

The adaptive filter W(z) processes the digital signal x(n) representing the sound collected by the first left microphone 130L, and outputs a signal y(n) at the time point n to the left DAC 240L. The signal y(n) is a digital signal representing a sound for reducing an environmental sound heard by the left ear LE. The filter coefficient of the adaptive filter W(z) is updated by the correction coefficient dw(n) calculated by the adaptive algorithm AR. Note that a structure for reducing an environmental sound heard by the right ear RE is also the same as in the case of the left ear LE.

Figure 6:
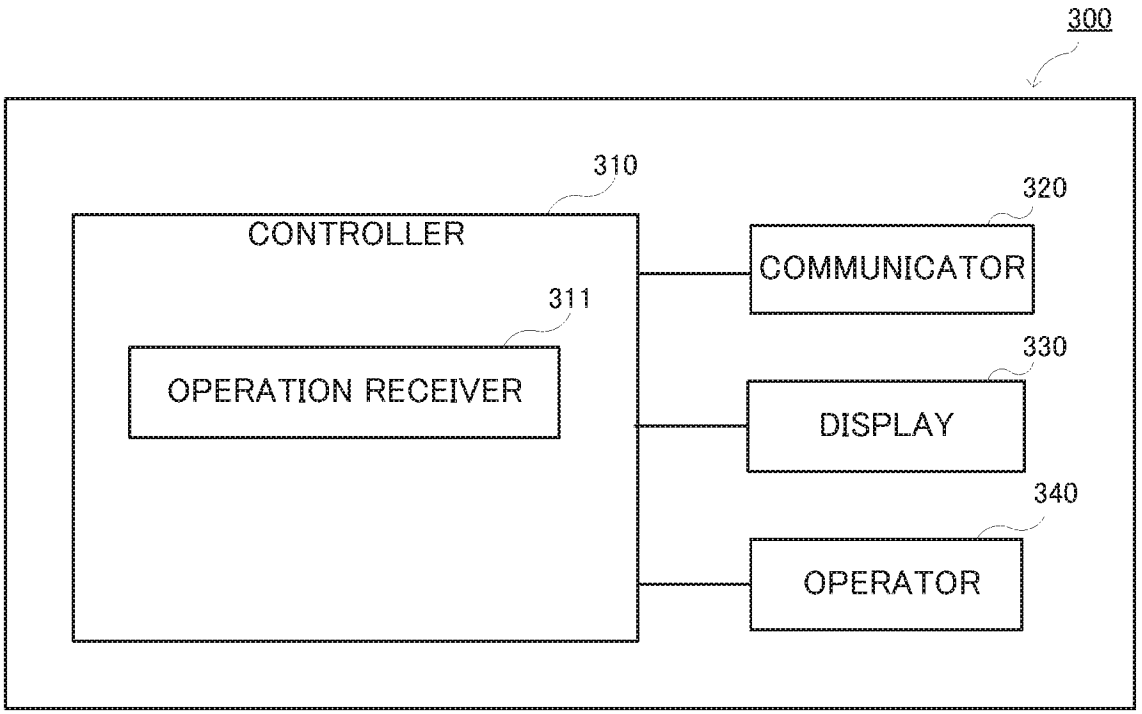
FIG. 6 is a block diagram illustrating the structure of the terminal device according to the embodiment.

The terminal device 300 includes a processor 310, a communicator 320, a display 330, and an operator 340, as illustrated in FIG. 6.

The processor 310 comprises a CPU, a ROM, a RAM, and the like. The processor 310 reads out a program stored in the ROM into the RAM and executes the program to function as an operation receiver 311.

The operation receiver 311 receives the data indicating whether or not the hood 102 is in use, and transmits the received data indicating whether or not the hood 102 is in use to the acoustic control unit 200 via the communicator 320.

The communicator 320 comprises a wireless communication module, such as a wireless LAN or Bluetooth (registered trademark), similarly to the above-mentioned communicator 260.

The display 330 displays an image necessary for operation, and comprises a liquid crystal display (LCD) or the like.

The operator 340 receives the data indicating whether or not the hood 102 is in use and instructions for starting and ending processing based on input by a user. Note that the operator 340 and the display 330 forms a touch panel display device.

Next will be a description of acoustic control processing executed by the loudspeaker device 100 having the above structure.

Figure 7:
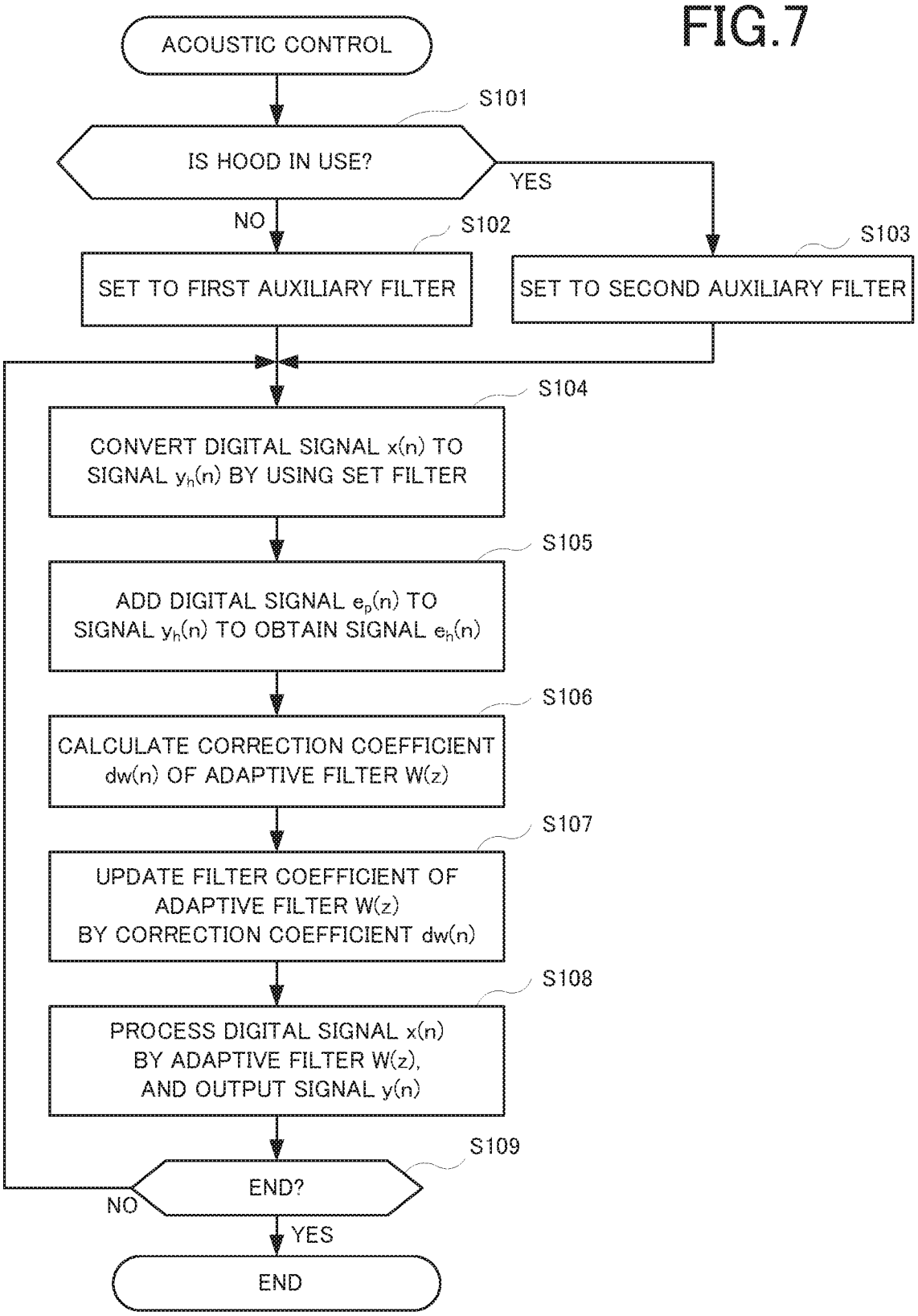
FIG. 7 is a flowchart illustrating acoustic control processing according to the embodiment.

The loudspeaker device 100 starts the acoustic control processing illustrated in FIG. 7 in response to receipt of data indicating an instruction for starting the processing by the user from the terminal device 300. Hereinafter, the acoustic control processing executed by the loudspeaker device 100 will be described using a flowchart.

When the acoustic control processing is started, the setter 211 determines whether or not the hood 102 is in use (step S101). Specifically, the setter 211 determines whether or not the hood 102 is in use based on the data transmitted from the terminal device 300 indicating whether or not the hood 102 is in use. When the hood 102 is not in use (step S101: No), the setter 211 sets the auxiliary filter that is used by the acoustic controller 212 to the first auxiliary filter $H_1(z)$ (step S102). When the hood 102 is in use (step S101: Yes), the setter 211 sets the auxiliary filter that is used by the acoustic controller 212 to the second auxiliary filter $H_2(z)$ (step S103). The first auxiliary filter $H_1(z)$ is set to the filter coefficient optimized for the situation where the hood 102 is not used. Additionally, the second auxiliary filter $H_2(z)$ is set to the filter coefficient optimized for the situation where the hood 102 is used.

Hereinafter, a description will be given of a principle for reducing an environmental sound heard by the left ear LE. The acoustic controller 212 uses the first auxiliary filter $H_1(z)$ or the second auxiliary filter $H_2(z)$ set at step S102 or step S103 to convert the digital signal x(n) converted by the left first ADC 220L representing the sound at the time point n collected by the first left microphone 130L to the signal $y_h(n)$ that is the filtered reference signal at the time point n (step S104). Digital signal processing filters, such as IIR filters or FIR filters, are used as the first auxiliary filter $H_1(z)$ and the second auxiliary filter $H_2(z)$. Next, the acoustic controller 212 adds the digital signal $e_p(n)$ converted by the left second ADC 230L representing the sound at the time point n collected by the second left microphone 140L to the signal $y_h(n)$ to obtain the signal $e_h(n)$ (step S105).

Next, the acoustic controller 212 calculates the correction coefficient dw(n) of the adaptive filter W(z) at the time point n by the adaptive algorithm AR based on a signal obtained by converting the digital signal x(n) converted by the left first ADC 220L by using the head-related transfer function (HRTF) $\hat{S}_v(z)$ and the signal $e_h(n)$ (step S106). An algorithm, such as RLS, LMS, or NLMS, is used as the adaptive algorithm AR. Then, the adaptive filter W(z) updates the filter coefficient of the adaptive filter W(z) by the correction coefficient dw(n) calculated by the adaptive algorithm AR (step S107).

Next, the adaptive filter W(z) that has updated the filter coefficient processes the digital signal x(n) converted by the left first ADC 220L, and outputs the signal y(n) at the time point n to the left DAC 240L (step S108). The signal y(n) is a digital signal representing a sound for reducing the environmental sound heard by the left ear LE. The signal y(n) output to the left DAC 240L is converted to an analog signal by the left DAC 240L. The converted analog signal is output to the left amplifier 250L, and amplified by the left amplifier 250L. The amplified analog signal is output to the left loudspeaker 120L, and the left loudspeaker 120L outputs the sound for reducing the environmental sound. Note that an environmental sound heard by the right ear RE is also reduced in the same manner as in the case of the left ear LE.

Next, it is determined whether an ending instruction has been received or not (step S109). When no ending instruction has not been received (step S109: No), processing returns to step S104 to repeat steps S104 to S109. When an ending instruction has been received (step S109: Yes), the acoustic control processing is ended.

Next will be a description of a method for setting the filter coefficients of the first auxiliary filter $H_1(z)$ and the second auxiliary filter $H_2(z)$.

Figure 8:
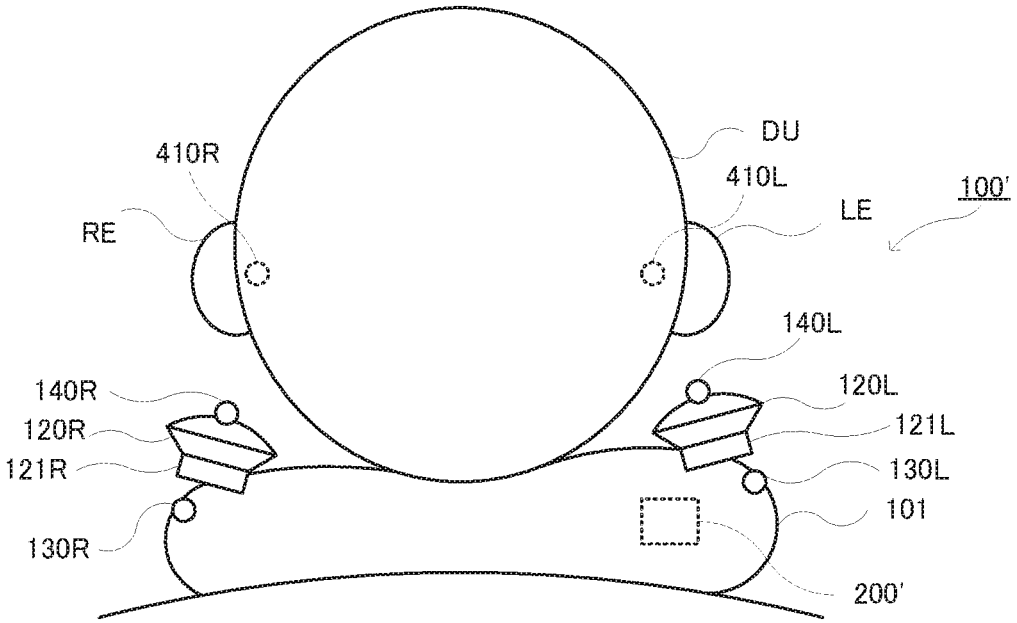
FIG. 8 is a diagram of a dummy doll attached with the loudspeaker device according to the embodiment.

As illustrated in FIG. 8, a loudspeaker device 100' is fitted around a neck portion of a dummy doll DU, and the filter coefficient of the first auxiliary filter $H_1(z)$ is set that is optimized for the situation where the hood 102 is not used. The dummy doll DU has a shape imitating a human head portion, and includes a third left microphone 410L at a position of the eardrum of the left ear LE and a third right microphone 410R at a position of the eardrum of the right ear RE.

Figure 9:
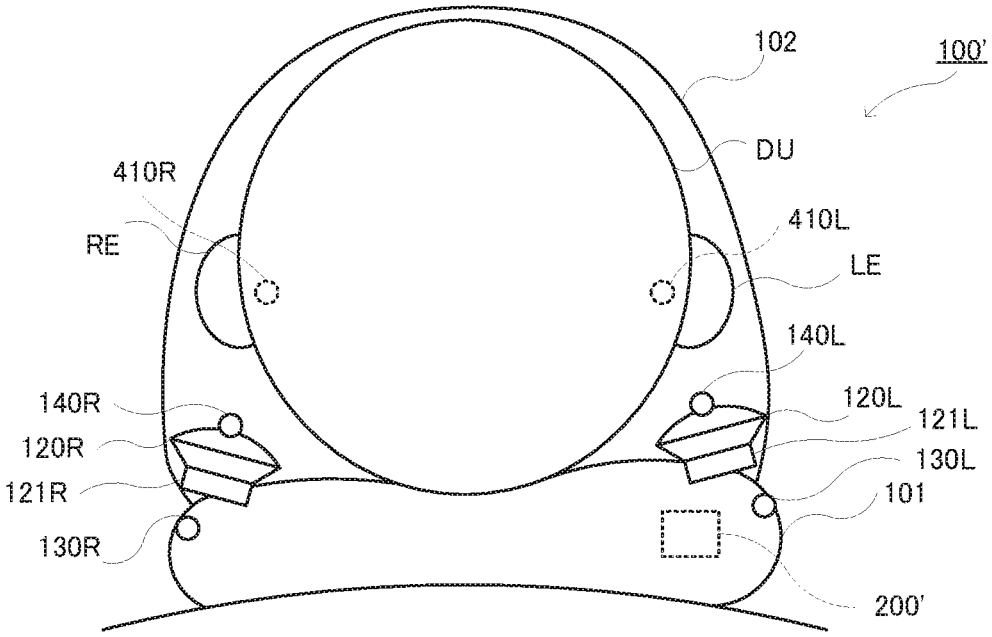
FIG. 9 is a diagram of the dummy doll attached with the loudspeaker device according to the embodiment.

In addition, as illustrated in FIG. 9, the head portion of the dummy doll DU is covered by the hood 102, and the filter coefficient of the second auxiliary filter $H_2(z)$ is set that is optimized for the situation where the hood 102 is used.

Figure 10:
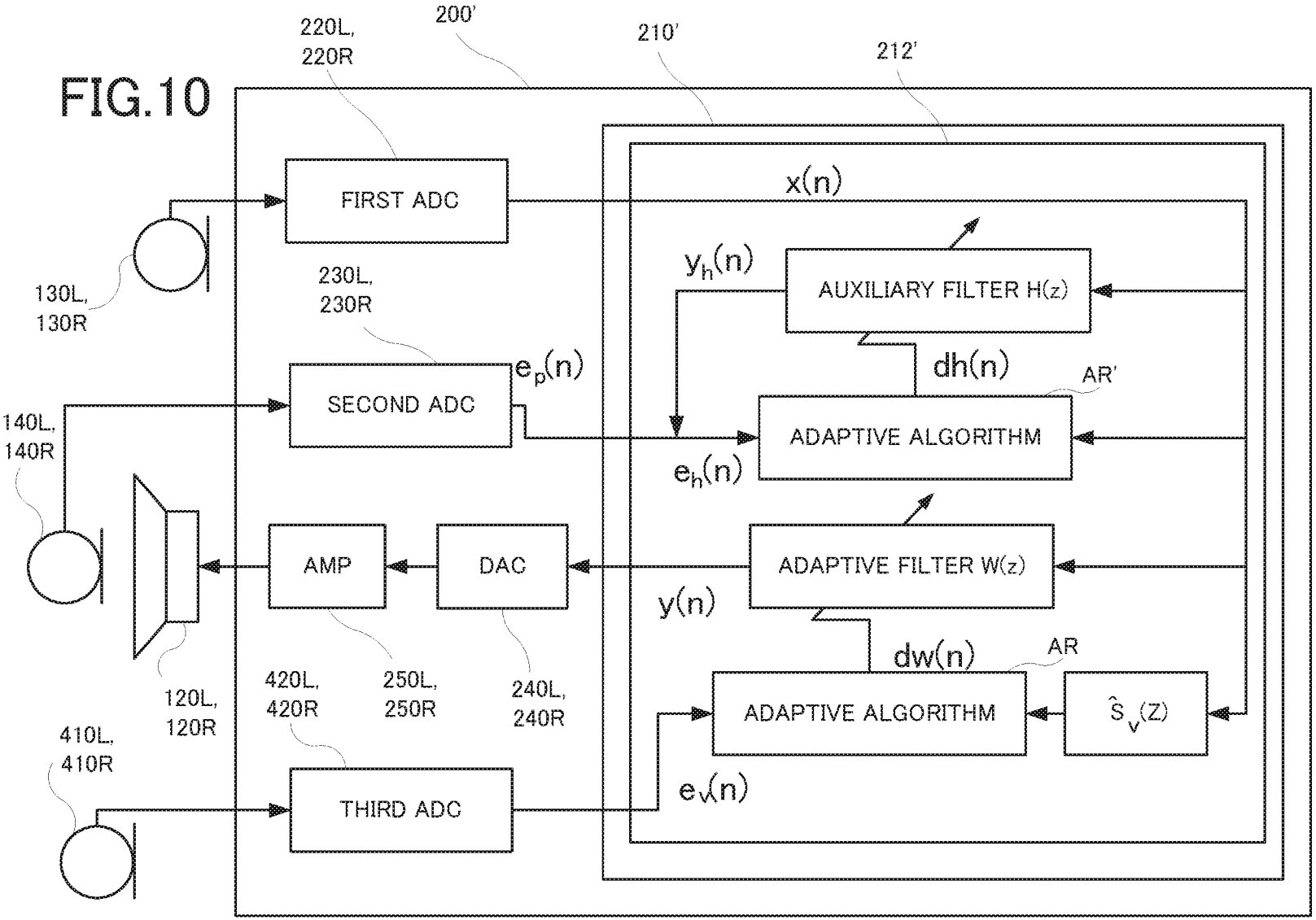
FIG. 10 is a diagram for describing a method for optimizing an auxiliary filter according to the embodiment.

The loudspeaker device 100' when setting the filter coefficients includes, in addition to the structure of the loudspeaker device 100, as illustrated in FIG. 10, an acoustic control unit 200' including a left third ADC 420L and a right third ADC 420R.

An acoustic controller 212' of a processor 210' controls the left loudspeaker 120L and the right loudspeaker 120R to output a sound for reducing an environmental sound so that sounds collected by the third microphone 410L and the third right microphone 410R become smallest, thereby setting the filter coefficient of the first auxiliary filter $H_1(z)$ and the filter coefficient of the second auxiliary filter $H_2(z)$. A specific description will be given of a principle for reducing an environmental sound collected by the third left microphone 410L arranged at the position of the eardrum of the left ear LE.

First, as illustrated in FIG. 8, the loudspeaker device 100' is fitted around the neck portion of the dummy doll DU, and the filter coefficient of the first auxiliary filter $H_1(z)$ is set that is optimized for the situation where the hood 102 is not used. Here will be described a case where an environmental sound heard by the left ear LE is reduced.

The acoustic controller 212' illustrated in FIG. 10 uses the auxiliary filter H(z) to convert the digital signal x(n) converted by the left first ADC 220L representing a sound at the time point n collected by the first left microphone 130L to the signal $y_h(n)$ that is the filtered reference signal at the time point n. A digital signal processing filter, such as an IIR filter or an FIR filter, is used as the auxiliary filter H(z). Next, the acoustic controller 212' adds the digital signal $e_p(n)$ converted by the left second ADC 230L representing a sound at the time point n collected by the second left microphone 140L to the signal $y_h(n)$ to obtain the signal $e_h(n)$ at the time point n.

Next, the acoustic controller 212' calculates the correction coefficient dh(n) of the auxiliary filter H(z) at the time point n by an adaptive algorithm AR' based on the digital signal x(n) converted by the left first ADC 220L and the signal $e_h(n)$. An algorithm, such as RLS, LMS, or NLMS, can be used as the adaptive algorithm AR'. Then, the auxiliary filter H(z) updates the filter coefficient by the correction coefficient dh(n) calculated by the adaptive algorithm AR'.

Next, the acoustic controller 212' calculates the correction coefficient dw(n) of the adaptive filter W(z) at the time point n by the adaptive algorithm AR based on a signal obtained by converting the digital signal x(n) converted by the left first ADC 220L by the head-related transfer function (HRTF) $\hat{S}_v(z)$ and a digital signal $e_v(n)$ converted by the left third ADC 420L representing a sound at the time point n collected by the third left microphone 410L. The third left microphone 410L is arranged at the position of the eardrum of the left ear LE.

Next, the adaptive filter W(z) updates the filter coefficient by the correction coefficient dw(n) calculated by the adaptive algorithm AR. Then, the adaptive filter W(z) that has updated the filter coefficient processes the digital signal x(n) converted by the left first ADC 220L, and outputs the signal y(n) at the time point n to the left DAC 240L. The signal y(n) is a digital signal representing a sound for reducing the environmental sound heard by the left ear LE.

Then, the signal y(n) output to the left DAC 240L is converted to an analog signal by the left DAC 240L. The converted analog signal is output to the left amplifier 250L, and amplified by the left amplifier 250L. The amplified analog signal is output to the left loudspeaker 120L, and the left loudspeaker 120L outputs the sound for reducing the environmental sound.

When the sound is output from the left loudspeaker 120L, the second left microphone 140L collects the sound output from the left loudspeaker 120L. The collected sound is converted to the digital signal $e_p(n)$ and fed back to the adaptive algorithm AR'. The adaptive algorithm AR' uses the fed-back digital signal $e_p(n)$ to calculate the correction coefficient dh(n) of the auxiliary filter H(z). Next, the auxiliary filter H(z) updates the filter coefficient by the correction coefficient dh(n) calculated by the adaptive algorithm AR'. The fed-back digital signal $e_p(n)$ is used to update the filter coefficient by the correction coefficient dh(n) calculated by the adaptive algorithm AR' for a predetermined period to optimize the auxiliary filter H(z).

The auxiliary filter H(z) optimized as above is set as the first auxiliary filter $H_1(z)$ optimized for the situation where the hood 102 is not used. By setting as above, the filter coefficient of the first auxiliary filter $H_1(z)$ is optimized such that the environmental sound does not reach the third left microphone 410L. Note that even when reducing an environmental sound heard by the right ear RE, the method for setting the filter coefficient is executed in the same manner as in the case of the left ear LE to set the first auxiliary filter $H_1(z)$.

Furthermore, similarly, even in the case where the loudspeaker device 100' is fitted so as to cover the head portion of the dummy doll DU by the hood 102, the filter coefficient of the second auxiliary filter $H_2(z)$ optimized for the situation where the hood 102 is used is set for each of the left ear LE and the right ear RE, as illustrated in FIG. 9.

As described above, according to the loudspeaker device 100 of the present embodiment, the neckwear 101 holds the left loudspeaker 120L and the right loudspeaker 120R in the reference range away from the left ear LE and the right ear RE, respectively, of the user U by the reference distance d, so that the neckwear 101 can be worn without exerting any unpleasant feeling of pressure upon the ears. Additionally, the hood 102 that covers the back of the head portion and the left and right ears LE and RE of the user U can reduce environmental sounds in a high frequency region of approximately 1000 Hz or higher. In addition, the acoustic controller 212 controls the left loudspeaker 120L and the right loudspeaker 120R so as to output sounds for reducing environmental sounds based on audio signals representing sounds collected by the first left microphone 130L, the second left microphone 140L, the first right microphone 130R, and the second right microphone 140R, thereby enabling reduction of the environmental sounds. The left loudspeaker 120L and the right loudspeaker 120R can mainly reduce environmental sounds having frequencies of approximately 1000 Hz or less. The processor 210 of the loudspeaker device 100 includes the first auxiliary filter $H_1(z)$ optimized for the situation where the hood 102 is not used and the second auxiliary filter $H_2(z)$ optimized for the situation where the hood 102 is used, and performs processing in accordance with each of the situations, thereby enabling further reduction of environmental sounds. Accordingly, the loudspeaker device 100 can attenuate environmental sounds without exerting any unpleasant feeling of pressure upon the ears.

(Modifications)

While the above embodiment has described the structure of the loudspeaker device 100 for reducing environmental sounds, the loudspeaker device 100 may further output sounds including music or the like to be appreciated. In this case, the loudspeaker device 100 receives audio data transmitted from the terminal device 300, and outputs the received audio data from the left loudspeaker 120L and the right loudspeaker 120R via the left DAC 240L and the right DAC 240R, respectively. The sounds output from the left loudspeaker 120L and the right loudspeaker 120R are collected by the second left microphone 140L and the second right microphone 140R. The collected sounds are converted to digital signals $e_p(n)$ by the left second ADC 230L and the right second ADC 230R, respectively. Since the digital signals $e_p(n)$ include signals output as sounds from the left loudspeaker 120L and the right loudspeaker 120R, digital signals obtained by deducting the signals output as the sounds are used in the acoustic control processing. As a result, even when a sound such as music to be appreciated is included, an environmental sound that is a sound other than the sound can be reduced.

Figure 11:
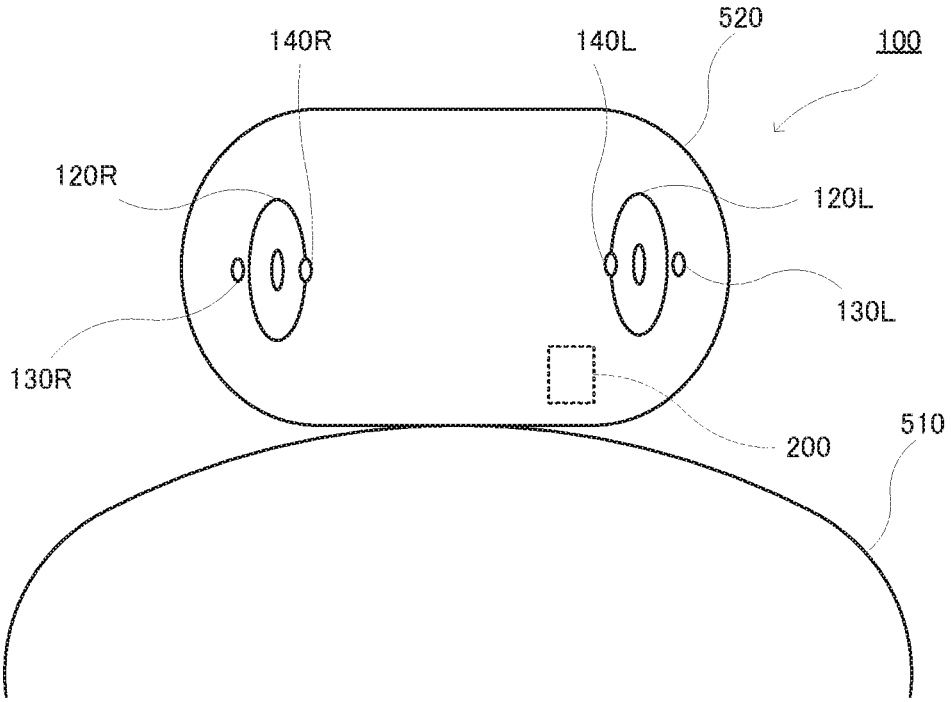
FIG. 11 is a diagram illustrating a loudspeaker device according to a modification.

The present embodiment described above has described the case where the loudspeaker device 100 includes the neckwear 101. It is sufficient that the loudspeaker device 100 can hold the left loudspeaker 120L and the right loudspeaker 120R in the reference range away from the left ear LE and the right ear RE, respectively, of the user U by the reference distance d. For example, as illustrated in FIG. 11, the left loudspeaker 120L and the right loudspeaker 120R may be attached to a headrest 520 of a seat 510 in a car of a railroad train or the like or in an airplane. In this way, the headrest 520 functions as a loudspeaker holder holding the left loudspeaker 120L and the right loudspeaker 120R of the loudspeaker device 100 in the reference range away from the left ear LE and the right ear RE of the user U by the reference distance d. As a result, environmental sounds generated by the car or the airplane can be reduced. In addition, the left loudspeaker 120L and the right loudspeaker 120R may also be attached to the headrest 520 of a sofa used in a room.

Figure 12:
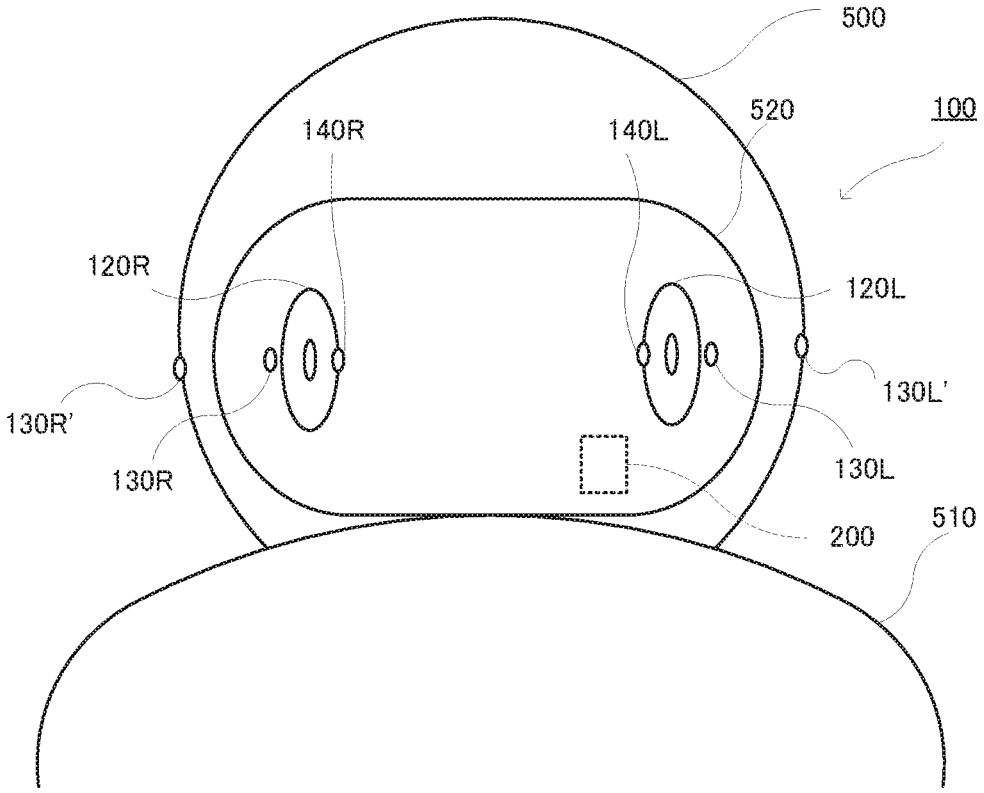
FIG. 12 is a diagram illustrating a loudspeaker device according to a modification.

The above embodiment has described the example of the loudspeaker device 100 including the hood 102. It is sufficient that the loudspeaker device 100 includes a sound proofing wall covering the left ear LE and the right ear RE of the user U, the left loudspeaker 120L, the second left microphone 140L, the right loudspeaker 120R, and the second right microphone 140R. As illustrated in FIG. 12, the left loudspeaker 120L and the right loudspeaker 120R may be attached to the headrest 520 of the seat 510 in a car of a railroad train or the like or in an airplane, and a headcover 530 may be attached to the seat 510 so as to cover the head of the user U. The headcover 530 is formed using a material having at least one of a sound absorbing effect or a sound insulating effect. As a result, the headcover 530 can reduce environmental sounds in a high frequency region of approximately 1000 Hz or more by covering the left ear LE and the right ear RE of the user U. In this case, a first left microphone 130L' and a first right microphone 130R' attached outside the headcover 530 are used in place of the first left microphone 130L and the first right microphone 130R. The headcover 530 functions as the sound proofing wall covering the left ear LE and the right ear RE of the user U, the left loudspeaker 120L, the second left microphone 140L, the right loudspeaker 120R, and the second right microphone 140R. As a result, environmental sounds generated by the car or the airplane can be reduced. Additionally, the headcover 530 may be storable in the seat 510 when not needed. In this way, the headcover 530 can be used only when needed.

The above embodiment has described the example of the acoustic controller 212 of the loudspeaker device 100 including the first and second auxiliary filters $H_1(z)$ and $H_2(z)$, the adaptive filter W(z), and the adaptive algorithm AR. The acoustic controller 212 can be any acoustic controller that can control so as to allow the left loudspeaker 120L and the right loudspeaker 120R to output sounds for reducing environmental sounds. For example, the acoustic controller 212 controls the left loudspeaker 120L and the right loudspeaker 120R to output sounds for reducing environmental sounds based on electrical signals representing sounds collected by the first left microphone 130L, the second left microphone 140L, the first right microphone 130R, and the second right microphone 140R. In this case, the acoustic controller 212 may include a first control mode optimized for a situation where the hood 102 or the headcover 530 is not used and a second control mode optimized for a situation where the hood 102 or the headcover 530 is used. The first control mode and the second control mode may be optimized by using the dummy doll DU including the third left microphone 410L at the position of the eardrum of the left ear LE and the third right microphone 410R at the position of the eardrum of the right ear RE, similarly to the above-described embodiment. The first control mode may be optimized such that environmental sounds do not reach the third left microphone 410L and the third right microphone 410R while the head portion of the dummy doll DU is not covered by the hood 102 or the headcover 530. The second control mode may be optimized such that environmental sounds do not reach the third left microphone 410L and the third right microphone 410R while the head portion of the dummy doll DU is covered by the hood 102 or the headcover 530. As a result, processing is performed in accordance with each of the situations, so that environmental sound reduction can be further improved. Note that the first control mode includes a mode in which the acoustic controller 212 of the loudspeaker device 100 of the above embodiment controls using the first auxiliary filter $H_1(z)$, and the second control mode includes a mode in which the acoustic controller 212 thereof controls using the second auxiliary filter $H_2(z)$.

The above embodiment has described the example of the loudspeaker device 100 including the left loudspeaker 120L and the right loudspeaker 120R. The loudspeaker device 100 can be any loudspeaker device that includes at least one loudspeaker, and even in this case, the loudspeaker device 100 can reduce an environmental sound heard by at least the left ear LE or the right ear RE.

In addition, a main part of the acoustic control processing executed by the loudspeaker device 100 comprising the CPU, the RAM, the ROM, and the like and the terminal device 300 can be executed not by a dedicated system but by using an ordinary information mobile terminal (a smartphone or a tablet PC), a personal computer, or the like. For example, a computer program for executing the above-described operation may be distributed by being stored in a non-transitory computer-readable recording medium (a flexible disc, a compact disc read only memory (CD-ROM), a digital versatile disc read only memory (DVD-ROM), or the like), and the computer program may be installed in an information mobile terminal or the like to configure an information terminal for executing the above-described processing. Alternatively, the computer program may be stored in a storage device of a server apparatus on a communication network such as the Internet, and for example, may be downloaded by an ordinary information processing terminal or the like to configure an information processing device.

Additionally, for example, when implementing the functions of the loudspeaker device 100 and the terminal device 300 by sharing between an operating system (OS) and an application program or by cooperation between the OS and the application program, only the application program may be stored in a non-transitory recording medium or a storage device.

Furthermore, the computer program can be superimposed on a carrier wave and distributed via a communication network. For example, the computer program may be presented on a bulletin board system (BBS) on the communication network, and distributed via the network. Then, the computer program may be started and executed in the same manner as in other application programs under control of the OS, thereby enabling execution of the above-described processing.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A loudspeaker device comprising:

a sound proofer reducing an environmental sound having a high frequency that is higher than a specific frequency when the sound proofer is worn by a user to cover a back of a head portion, a left ear, and a right ear of the user;

at least one loudspeaker located inside the sound proofer;

a first microphone located outside the sound proofer, and collecting an environmental sound and outputting an electrical signal;

a second microphone located inside the sound proofer, the second microphone collecting a synthetic sound synthesized from a sound output from the at least one loudspeaker and the environmental sound and outputting an electrical signal; and a processor controlling the at least one loudspeaker so as to output a sound for reducing an environmental sound having a low frequency that is lower than the specific frequency based on the electrical signals representing the sounds collected by the first microphone and the second microphone.

2. The loudspeaker device according to claim 1, wherein the sound proofer includes a neckwear, formed using a flexible material and having a ring shape or a U-shape, to be wound around a neck of the user.

3. The loudspeaker device according to claim 1, wherein the sound proofer includes a headrest to be attached to a seat, the headrest holding the at least one loudspeaker in a reference range away from the left ear and the right ear of the user by a reference distance.

4. The loudspeaker device according to claim 1, wherein the sound proofer is formed by a sound proofing sheet that is shaped to be wearable on a head of the user and that has at least one of a sound absorbing effect or a sound insulating effect.

5. A loudspeaker device comprising:

at least one loudspeaker;

a loudspeaker holder holding the at least one loudspeaker in a reference range away from an ear of a user by a reference distance;

a first microphone collecting an environmental sound and outputting a first signal;

a second microphone attached to a position where a sound output from the at least one loudspeaker is collected, the second microphone collecting a synthetic sound synthesized from the sound output from the at least one loudspeaker and the environmental sound and outputting a second signal; and a processor executing an adaptive filter configured to perform filter processing depending on a filter coefficient set for the first signal and output a third signal indicating a sound for reducing the environmental sound, an auxiliary filter configured to perform filter processing for the first signal, the filter processing being set to a use situation, and output a filtered reference signal, and an adaptive algorithm configured to calculate a correction coefficient of the adaptive filter based on the first signal, the second signal, and the filtered reference signal, and update a filter coefficient of the adaptive filter by the correction coefficient.

6. The loudspeaker device according to claim 5, wherein the adaptive algorithm calculates a correction coefficient of the adaptive filter based on the second signal, the filtered reference signal, and a signal obtained by converting the first signal by using a head-related transfer function.

7. The loudspeaker device according to claim 5, wherein a filter coefficient that differs depending on a presence of a sound proofer that covers an area surrounding ears of a user is set to the auxiliary filter.

8. The loudspeaker device according to claim 7, wherein the processor selects either a first control mode optimized for a situation where the sound proofer is not used or a second control mode optimized for a situation where the sound proofer is used, and the auxiliary filter having a filter coefficient optimized for the situation where the sound proofer is not used, is used in the first control mode, and the auxiliary filter having a filter coefficient optimized for the situation where the sound proofer is used, is used in the second control mode.

9. The loudspeaker device according to claim 8, wherein by using a dummy doll including a third microphone at a position of an eardrum, the auxiliary filter in the first control mode is optimized such that the environmental sound does not reach the third microphone in a situation where a head of the dummy doll is not covered by the sound proofer, and the auxiliary filter in the second control mode is optimized such that the environmental sound does not reach the third microphone in a situation where the head of the dummy doll is covered by the sound proofer.

10. An acoustic control method for controlling sound by using a loudspeaker device that includes at least one loudspeaker, a loudspeaker holder holding the at least one loudspeaker in a reference range away from an ear of a user by a reference distance, a first microphone collecting an environmental sound and outputting a first signal, and a second microphone attached to a position where a sound output from the at least one loudspeaker is collected, the second microphone collecting a synthetic sound synthesized from the sound output from the at least one loudspeaker and the environmental sound and outputting a second signal, the method comprising processing of:

an adaptive filter performing filter processing based on a filter coefficient set for the first signal and outputting a third signal indicating a sound for reducing the environmental sound;

an auxiliary filter performing filter processing for the first signal, the filter processing being set to a use situation, and outputting a filtered reference signal; and an adaptive algorithm calculating a correction coefficient of the adaptive filter based on the first signal, the second signal, and the filtered reference signal, and updating a filter coefficient of the adaptive filter by the correction coefficient.

11. A non-transitory recording medium recorded with a computer-readable program for controlling a loudspeaker device that includes at least one loudspeaker, a loudspeaker holder holding the at least one loudspeaker in a reference range away from an ear of a user by a reference distance, a first microphone collecting an environmental sound and outputting a first signal, and a second microphone attached to a position where a sound output from the at least one loudspeaker is collected, the second microphone collecting a synthetic sound synthesized from the sound output from the at least one loudspeaker and the environmental sound and outputting a second signal, the program causing a computer to function as a processor executing processing of:

an adaptive filter performing filter processing based on a filter coefficient set for the first signal and outputting a third signal indicating a sound for reducing the environmental sound;

an auxiliary filter performing filter processing for the first signal, the filter processing being set to a use situation, and outputting a filtered reference signal; and an adaptive algorithm calculating a correction coefficient of the adaptive filter based on the first signal, the second signal, and the filtered reference signal, and updating a filter coefficient of the adaptive filter by the correction coefficient.

* * * * *